US006062151A

United States Patent [19]

Meade et al.

[11] Patent Number: 6,062,151

[45] Date of Patent: May 16, 2000

[54] TUFTING NEEDLE WITH OFFSET STEM

[75] Inventors: Warren John Meade; Angela Margaret Phillips, both of Christchurch; Joan Emma Harneiss, Canterbury, all of New Zealand

[73] Assignee: Groz-Beckert KG, Germany

[21] Appl. No.: 09/150,073

[22] Filed: Sep. 9, 1998

[51] Int. Cl.[7] ..... D05C 15/04; D05B 85/10

[52] U.S. Cl. ..... 112/80.16; 112/222

[58] Field of Search ..... 112/222, 80.01, 112/80.4, 80.45, 80.05

[56] References Cited

U.S. PATENT DOCUMENTS 2,990,792 7/1961 Nowicki et al. ..... 112/80.01 X
3,929,082 12/1975 Zocher ..... 112/222
3,954,072 5/1976 Zocher ..... 112/222
4,195,584 4/1980 Falk et al. ..... 112/222
4,233,917 11/1980 Carnaby ..... 112/222

*Primary Examiner*—Ismael Izaguirre
*Attorney, Agent, or Firm*—John C. Purdue; David C. Purdue

[57] ABSTRACT

A tufting needle is disclosed. The needle has a shank (1) and a stem (2). The needle has a lower eye (4) in the stem (2) which is close to the tip (3) and an upper eye (6 in FIG. 1, and 15 in FIG. 2), and a thread-guiding groove (7) on one side running along the stem (2) and connecting the eyes (4 and 6 in FIGS. 1, and 4 and 15 in FIG. 2). The needle also has a transitional segment (5 in FIG. 1, and 14 in FIG. 2) between the lower end of the shank (1) and the upper end of the stem (2). The stem is offset with respect to the shank (1) but runs parallel thereto; the upper eye (6 in FIG. 1, and 15 in FIG. 2) is in the transitional segment (5 in FIG. 1 and 14 in FIG. 2) and is aligned with the thread-guiding groove (7).

12 Claims, 4 Drawing Sheets

TUFTING NEEDLE WITH OFFSET STEM

BAKCGROUND OF THE INVENTION

1. Field of the Invention

The invention concerns a tufting needle as an individual needle and as an element of a needle module incorporating several such needles with a shank and a stem, in said stem a lower eye close to the tip of the needle and an upper eye, a thread-guiding groove on one side of the needle running along the needle stem and connecting said eyes.

2. Description of the Related Art

Such a tufting needle is known from UK patent 1 601 812 for throwing two loops of two pile yarns at a single penetration of the backing fabric by the needle. These yarns may be fed through an upper eye, a thread-guiding groove and a lower eye. For feeding the yarns to the upper eye it is necessary for them to be delivered at a considerable angle against the axis of the stem, so that it is unavoidable for the yarns to be deflected and thus to undergo friction forces, which in turn lead to considerable loads to be taken by the needles. Such forces and loads, however, may easily lead to breaks of the yarns and of the needles and thus to interruptions of the tufting procedure. Moreover the forces and loads caused by the deflection of the yarns lead to differences in the lengths of the loops which result in an uneven surface of the tufting product. this prior art it is the object of the present invention to attain a substantial Starting from this prior art it is the object of the present invention to attain a substantial reduction in the stated forces and loads on yarns and needles in tufting procedures.

In order to attain this objective, the invention provides for a tufting needle of the type mentioned at the beginning of this description which comprises a transitional segment between the lower end of said shank and the upper end of said stem, said stem being offset with respect to said shank but running parallel thereto, said upper eye being provided in said transitional segment in alignment with said thread-guiding groove.

DE-195 28 152 C1 shows a tufting needle having its stem offset with respect to its shank. With this needle, however, only one eye is provided being located close to the needle tip. There is no talking about how to deal with the object here concerned.

SUMMARY OF THE INVENTION

Starting from this prior art it is the object of the present invention to attain a substantial reduction in the stated forces and loads on yearns and needles in tufting procedures.

In order to attain this objective, the invention provides for a tufting needle of the type mentioned at the beginning of this description which comprises a transitional segment between the lower end of said shank and the upper end of said stem, said stem being offset with respect to said shank but running parallel thereto, said upper eye being provided in said transitional segment in alignment with said thread-guiding groove.

The advantages of the tufting needle according to the present invention primarily are as follows:

The feeding of the yarns is improved in downward and upward movement of the needle. Problems with knots and the like in the yarn, the frequency of yarn breaks, the wear-out of the upper eye, the need of energy and the amount of "Fly" are considerably reduced. The loops are formed more uniform.

Two particularly expedient embodiments of the object of this invention are specified in the sub-claims and in the following description:

DESCRIPTION OF THE PREFERRED EMBODIMENTS

Figure 1:
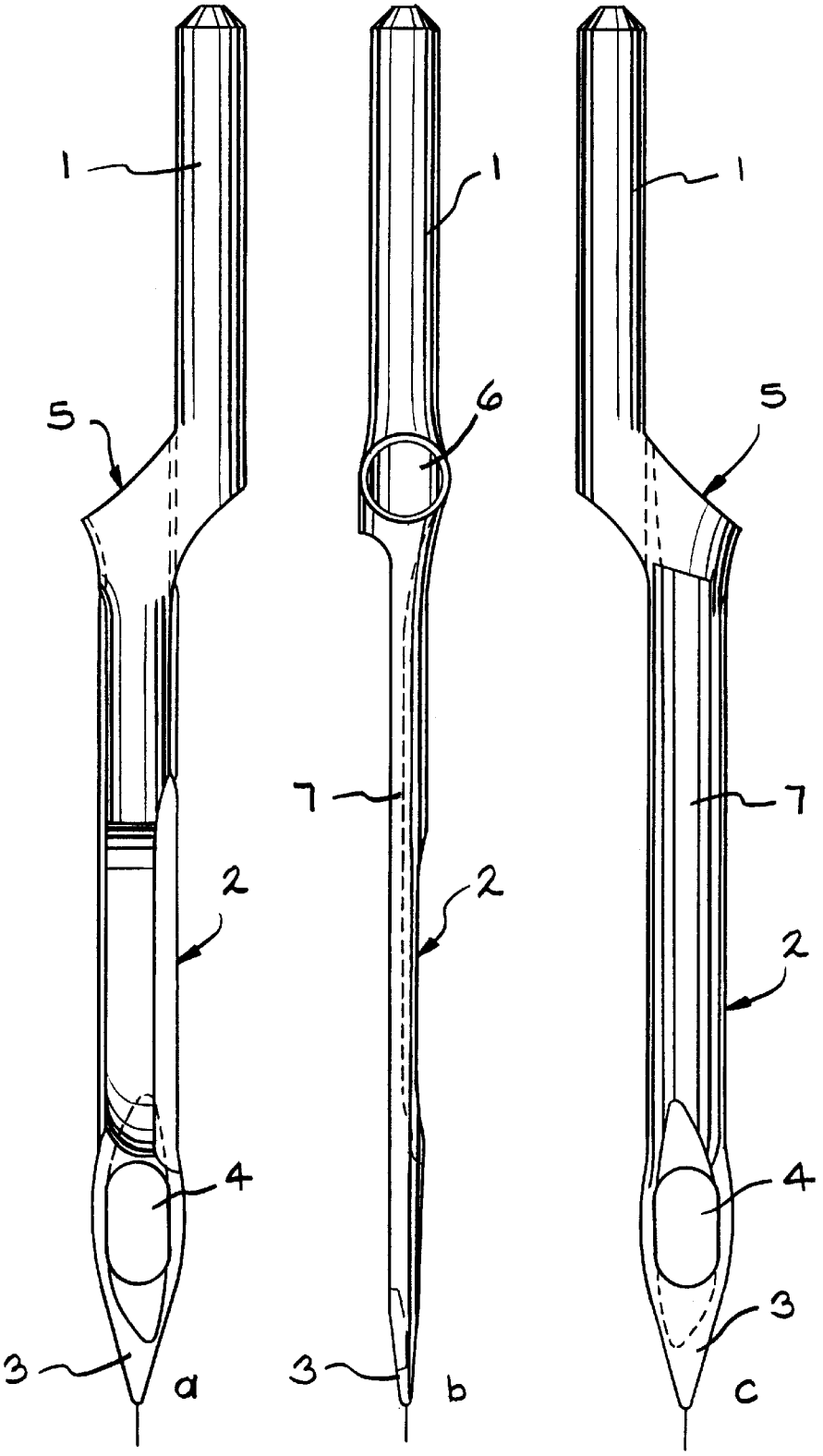
FIG. 1*a* shows a rear view of one embodiment of a tufting needle in accordance with the present invention.
FIG. 1*b* shows a side view of the needle in accordance with FIG. 1*a;*
FIG. 1*c* shows a front view of the needle in accordance with FIG. 1*a;*

The embodiment of the invention in accordance with FIG. 1 has a shank, 1, a stem, 2, a tip, 3, and a lower eye, 4. The stem, 2, is joined to the shank, 1, via a forwardly extending (i.e. away from the needle bar in its mounted position) transitional segment, 5. Shank, 1, and stem, 2, are offset in parallel with one another in a plane running perpendicularly to the plane defined by the row of needles. In the transitional segment, 5, an upwardly extending upper eye, 6, is provided which leads into the upper area of a thread guiding groove, 7. The lower eye, 4, and the upper eye, 6, open into directions running perpendicular to eachother.

This embodiment has the advantage that the yarn directly enters the yarn guiding groove-yarn protecting groove without any deflection of the yarn. As the yarn does not have to pass between the needles, the upper needle guide-eye, 6, can be relatively large (i.e. the width of the needle or larger). Threading is also easier because the yarn can be pushed or pulled down through the upper needle guide into the needle groove toward the lower needle eye from the relatively clear space above the upper needle guide. Effectively the upper needle guide of this embodiment incorporates the last guide bar on the tufting machine in a similar orientation, but located directly at the top of the yarn protection groove. Accordingly all of the same space considerations and hole size considerations that apply to the guide bar also apply to the upper needle guide.

Figure 2:
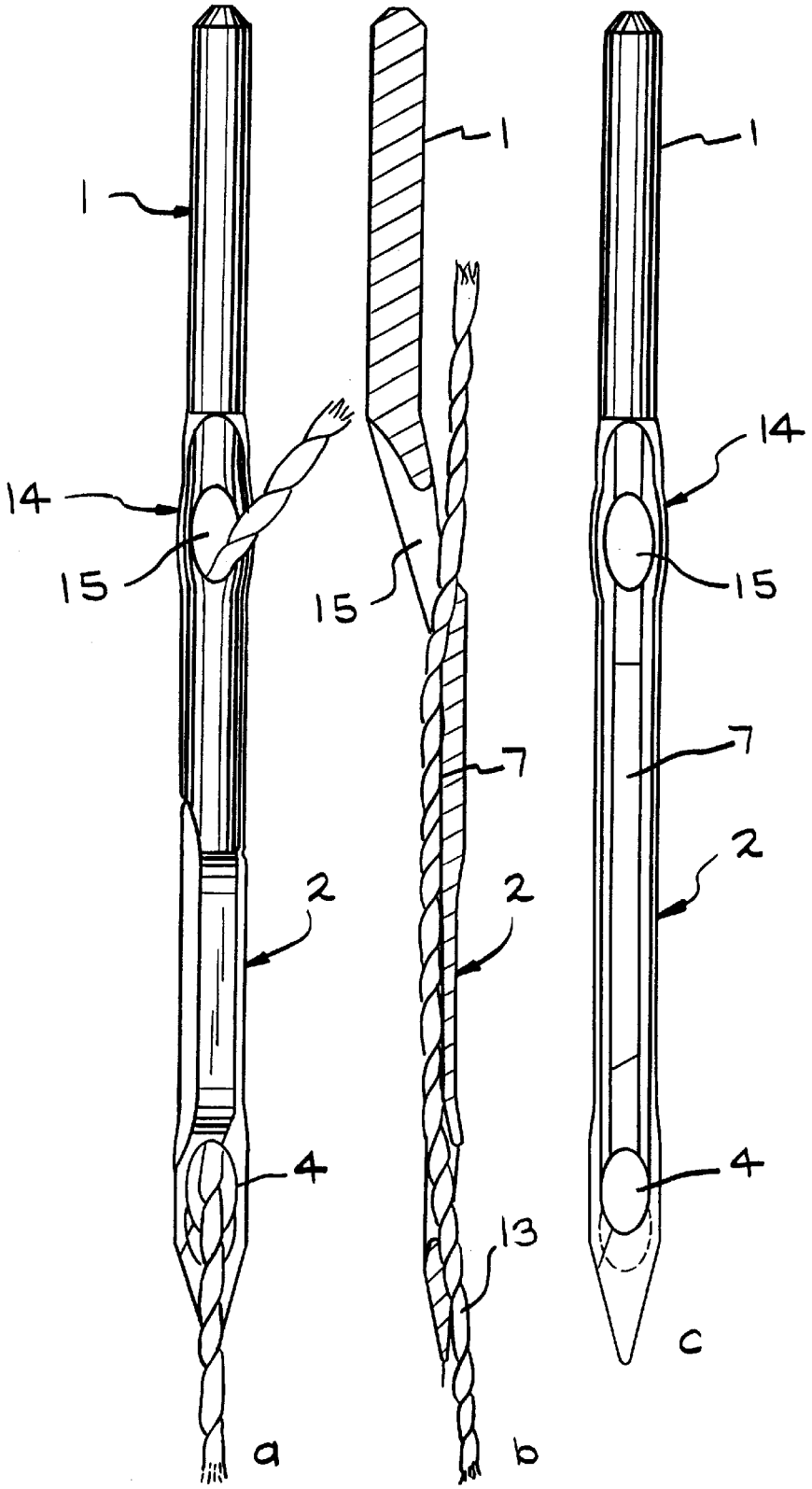
FIG. 2*a* shows a rear view of a further embodiment of a tufting needle in accordance with the present invention.
FIG. 2*b* shows a side view (sectional) of the needle and a yarn guided therein in accordance with FIG. 2*a;*
FIG. 2*c* shows a front view of the needle in accordance with FIG. 2*a.*

With the embodiment of the tufting needle in accordance with the present invention shown in FIG. 2 a transitional segment, 14, is provided between the shank, 1, and the stem, 2, with a lower eye, 4, and an upper eye, 15. The transitional segment, 14, which may be formed flat, is inclined with respect to the axes of the shank, 1, and the stem, 2. The inclination does not exceed 50°. Here again, the shank, 1, and the stem, 2, are offset in parallel with one another, but in a plane defined by the row of needles in their mounted position. The upper eye, 15, is followed by the thread-guiding groove, 7, (FIGS. 2*a,b* showing a yam, 13, being guided therein) on the stem, 2, whereby the straight continuation of the thread-guiding groove, 7, is aligned with the upper eye, 15. Both the lower eye, 4, and the upper eye, 15, open towards an adjacent needle.

The thread guideways and guide elements are smoothed and rounded in all embodiments of the invention.

The tufting needles can be designed in accordance with previously common configurations in the area of the tip. The same applies with regard to the side of the needles facing the thread guiding-groove, which is referred to as the rear side.

Figure 3:
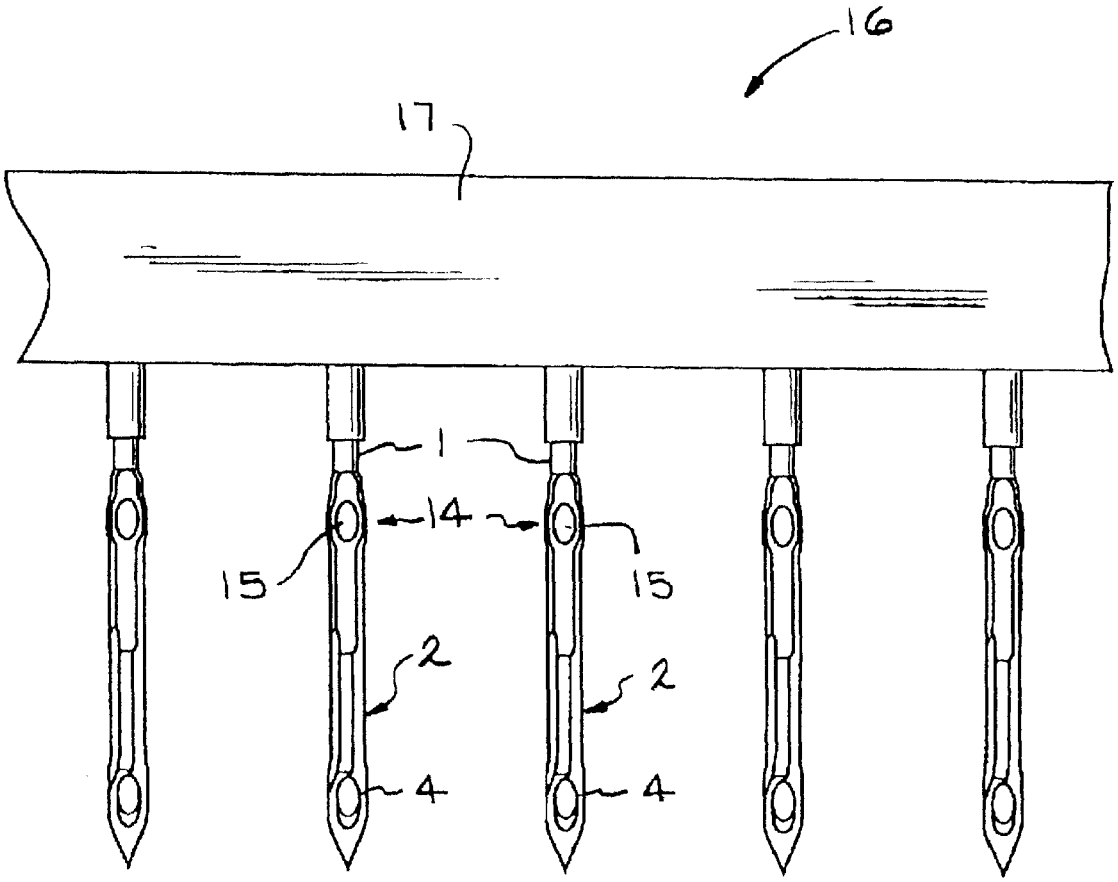
FIG. 3 shows a rear view of a needle module composed of a needle bar and four of the tufting needles of FIGS. 1*a,* 1*b* and 1*c.*

A needle module, a fragment of which is indicated generally at 16 in FIG. 3, is composed of a needle bar 17 and a plurality of the tufting needles of FIGS. 1*a,* 1*b* and 1*c.*

Figure 4:
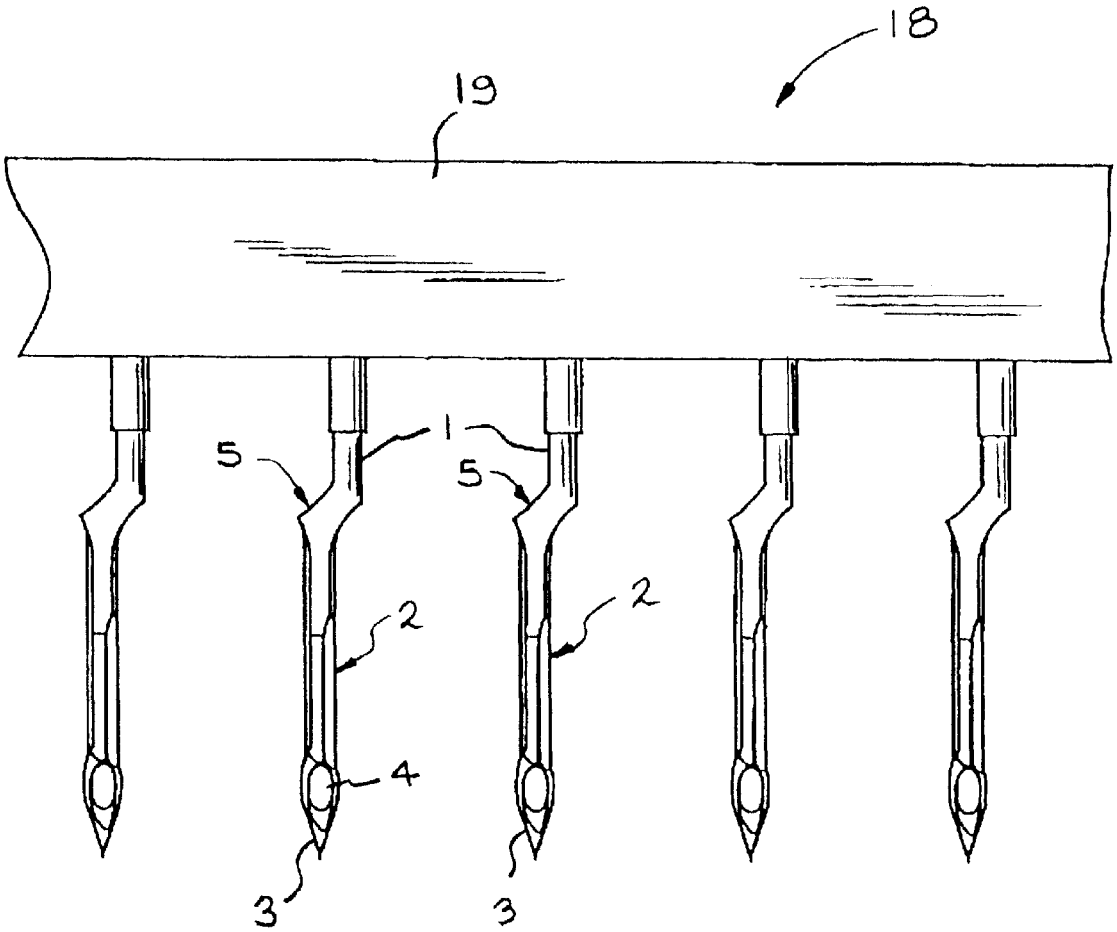
FIG. 4 shows a rear view of a needle module composed of a needle bar and four of the tufting needles of FIGS. 2*a,* 2*b* and 2*c.*

A needle module, a fragment of which is indicated generally at 18 in FIG. 4, is composed of a needle bar 19 and a plurality of the tufting needles of FIGS. 2*a,* 2*b* and 2*c.*

In its essential details, the invention is a tufting needle which has a shank (1), a stem (2), a lower eye (4) and an upper eye (6 in FIG. 1, and 15 in FIG. 2). The lower eye (4) is in the stem (2), close to the tip (3). The needle also has a thread-guiding groove (7) on one side running along the stem (2) and connecting the eyes (4 and 6 in FIGS. 1, and 4 and 15 in FIG. 2), and a transitional segment (5 in FIG. 1, and 14 in FIG. 2) between the lower end of the shank (1) and the upper end of the stem (2). The stem is offset with respect to the shank, but runs parallel thereto; the upper eye (6 in FIG. 1, and 15 in FIG. 2) is in the transitional segment (5 in FIG. 1 and 14 in FIG. 2) and is aligned with the thread-guiding groove (7). The invention is also a needle module (FIG. 3) composed of a needle bar and several of the needles of FIG. 1 or (FIG. 4) a needle module composed of a needle bar and several of the needles of FIG. 2.

We claim:

1. Tufting needle with a shank (1) and a stem (2), in said stem (2) a lower eye (4) close to the tip (3) of the needle and an upper eye (6,15), a thread-guiding groove (7) on one side of the needle running along the needle stem (2) and connecting said eyes (4, 6, 15), said needle comprising a transitional segment (5,14) between the lower end of said shank (1) and the upper end of said stem (2), said stem being offset with respect to said shank (1) but running parallel thereto, and said upper eye (6, 15) being provided in said transitional segment (14, 5) in alignment with said thread-guiding groove (7).

2. A needle module comprising a plurality of tufting needles as set forth in claim 1 mounted in a row in a needle bar, wherein said stems (2) are offset in relation to said shank (1) in a plane running transversely to the plane being defined by the row of needles in their mounted position (FIG. 1).

3. A needle module as claimed in claim 2 wherein said transitional segment (5, 14) is inclined with respect to the axes of said shank (1) and of said stem (2) as well.

4. A needle module comprising a plurality of tufting needles as set forth in claim 1 mounted in a row in a needle bar, wherein said stems (2) are offset in relation to said shank (1) in a plane defined by the row of needles in their mounted position (FIG. 2).

5. A needle module as claimed in claim 4 wherein said transitional segment (5, 14) is inclined with respect to the axes of said shank (1) and said stem (2) as well.

6. A needle module as claimed in claim 5 wherein the inclination of said transitional segment (5, 14) is less than 50°.

7. A needle module as claimed in claim 4 wherein said transitional segment (5,14) is flat (FIG. 2).

8. A needle module as claimed in claim 7 wherein the inclination of said transitional segment (5, 14) is less than 50°.

9. A needle module as claimed in claim 4 wherein said transitional segment (5,14) is flat (FIG. 2).

10. Tufting needle as set forth in claim 1, wherein said transitional segment (5, 14) is inclined with respect to the axes of said shank (1) and of said stem (2) as well.

11. Tufting needle as set forth in claim 10, wherein the inclination of said transitional segment (5,14) is less than 50°.

12. Tufting needle as set forth in claim 1, wherein said transitional segment (5, 14) is flat (FIG. 2).

* * * * *